United States Patent [19]

Nakamura et al.

[11] Patent Number: 4,859,560

[45] Date of Patent: Aug. 22, 1989

[54] TONER FOR USE IN ELECTROPHOTOGRAPHY

[75] Inventors: Tadashi Nakamura; Yaosuo Kitabatake; Yoshiaki Takahashi, all of Nara; Kazuya Maeda, Osaka, all of Japan

[73] Assignee: Sharp Kabushiki Kaisha, Osaka, Japan

[21] Appl. No.: 107,016

[22] Filed: Oct. 9, 1987

[30] Foreign Application Priority Data

Oct. 22, 1986 [JP] Japan ..... 61-252441

[51] Int. Cl.[4] ..... G03G 9/08

[52] U.S. Cl. ..... 430/137; 430/110; 430/138; 428/402

[58] Field of Search ..... 430/110, 138, 137; 428/402

[56] References Cited

U.S. PATENT DOCUMENTS

| | | | |
|---|---|---|---|
| 4,221,456 | 9/1980 | Lu | 430/110 |
| 4,265,994 | 5/1981 | Hasegawa et al. | 430/110 X |
| 4,288,519 | 9/1981 | Diamond et al. | 430/137 |
| 4,314,017 | 2/1982 | Takahashi et al. | 430/109 |
| 4,520,091 | 5/1985 | Kakimi et al. | 430/110 |
| 4,599,289 | 7/1986 | Suematsu et al. | 430/110 X |

FOREIGN PATENT DOCUMENTS

| | | | |
|---|---|---|---|
| 54-101328 | 8/1979 | Japan | 430/100 |

*Primary Examiner*—Paul R. Michl
*Assistant Examiner*—Jeffrey A. Lindeman
*Attorney, Agent, or Firm*—Flehr, Hohbach, Test, Albritton & Herbert

[57] ABSTRACT

A method of producing toner particles for use in electrophotography where the particles have a colored resin core particle containing a resin and a colorant and charge controlling layer on the particle's outer surface. The charge controlling layer contains a charge controlling agent but not any colorant. The method comprises the steps of:

(1) preparting toner core particles by mixing, kneading, crushing and sorting a first material including a resin material and a colorant, (2) preparing charge controlling particles with smaller diameters than the toner core particles by mixing, kneading, crushing and sorting a second material including a charge controlling agent, and (3) thereafter mixing the toner core particles the said charge controlling particles and causing a charge controlling layers to be formed around the toner core particles by applying a pressure to the mixed particles.

8 Claims, 3 Drawing Sheets

TONER FOR USE IN ELECTROPHOTOGRAPHY

BACKGROUND OF THE INVENTION

This invention relates to a toner for use in electrophotography as developer and more articularly to a method of producing such a toner.

The toner which is used as developer in electrophotography is usually a kneaded mixture of a resin material, a charge controlling agent and a colorant such as an organic pigment and is adapted to become electrostatically charged by friction with a carrier including reduced iron powder. Since colorants of many types are now available, toners can be of different colors such as red and blue and images of different colors can be formed therewith. Since toner particles become charged mainly through the charge controlling agent on their surfaces, their electrostatic characteristics are influenced significantly by the composition of the colorant present on their surfaces. Thus, if a toner of a different color is used, the composition of its colorant changes and hence also its electrostatic characteristics. As a result, it may happen that toner particles fail to become attached to a photosensitive surface effectively in an electrophotographic process and that the quality of the toner image formed thereon is adversely affected with the appearance of fog. In order to prevent such a result and to make the electrostatic characteristics of toner particles uniform, the types and quantities of charge controlling agents must be appropriately regulated by a very troublesome procedure. If different toners with different colorants are produced by using the same apparatus, on the other hand, different colorants and toner particles may become mixed together and sections with different electrostatic characteristics may appear locally. In order to prevent such an occurance, a washing machine may have to be provided for completely cleaning the production apparatus or a different production apparatus must be provided for toners with different colorants. By either method, production cost of toners becomes unreasonably high.

SUMMARY OF THE INVENTION

It is therefore an object of the present invention to provide a toner for use in electrophotography which can be charged uniformly and with which the toner image of high quality can be formed reliably.

It is another object of the present invention to provide a toner for use in electrophotography which can be produced economically.

The above and other objects of the present invention are achieved by producing toner particles with a core which does not contain any charge controlling agent and of which the external surface is covered by a layer having a charge controlling agent dispersed uniformly therethrough.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figures 1, 2, 3:
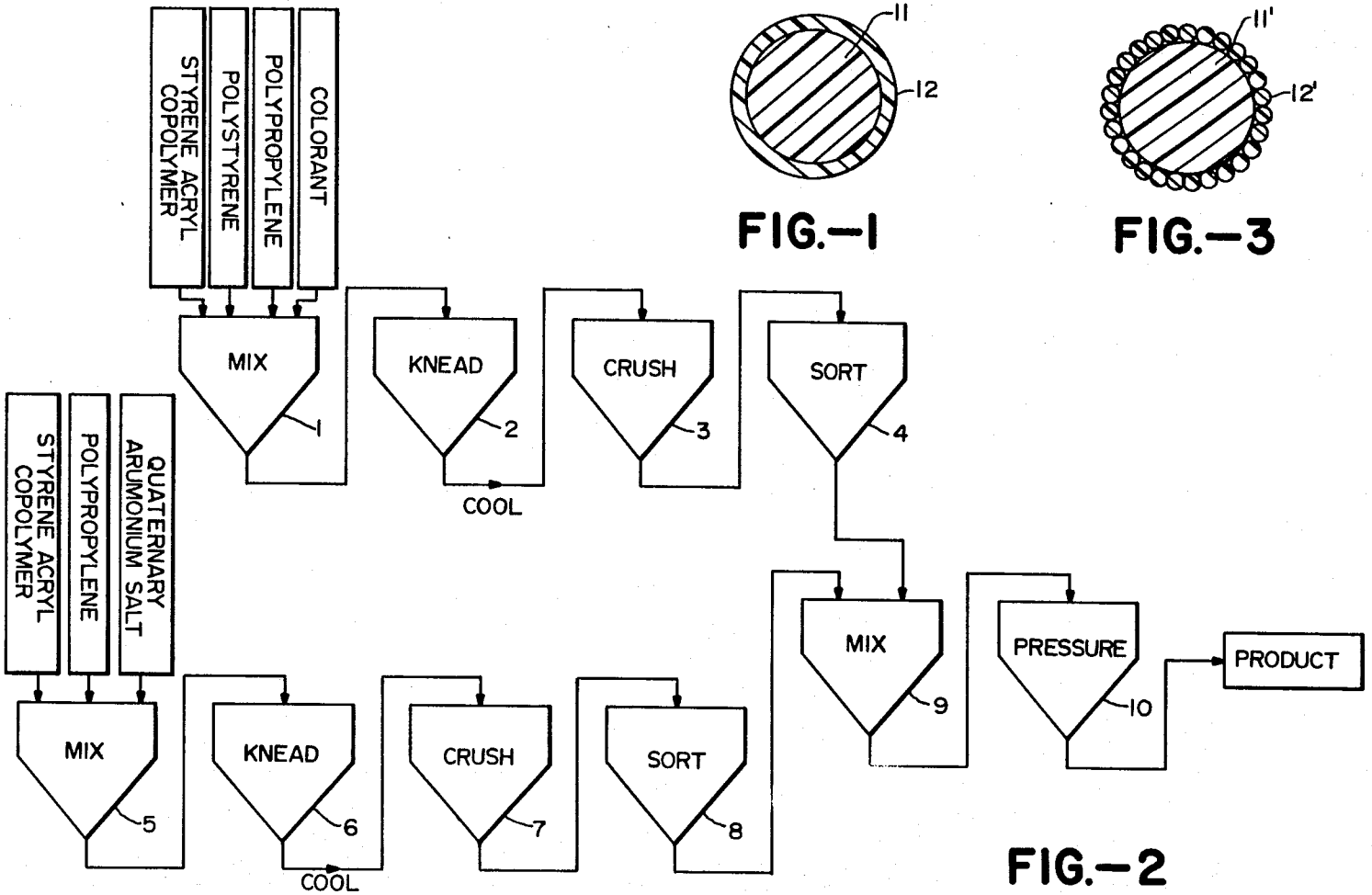
FIG. 1 is a sectional view of a toner particle embodying the present invention.
FIG. 2 is a drawing for schematically showing the production process for toner particles shown in FIG. 1.
FIG. 3 is a sectional view of a toner particle during the production process of FIG. 2.

Toner particles embodying the present invention are characterized, as shown in FIG. 1, as having a charge controlling layer 12 covering the external surface of a colored resin member 11. To manufacture such toner particles, colored resin particles containing a pigment and a charge controlling particles containing a charge controlling agent are separately prepared as shown in FIG. 2. Table 1 shows the ratios of constituent substances to be mixed for the colored resin particles and Table 2 shows the ratios of constituent substances for the charge controlling particles. Black, red, blue and green resin particles (Types A, B, C and D) contain styrene-acryl copolymer, polystyrene and polypropylene as the base material and a colorant of different colors. Black resin particles (A) are produced by mixing an inorganic black pigment such as carbon black. Resin particles of Types B, C and D are produced by mixing a red, blue and green organic pigment, respectively (Step 1 of FIG. 2). Next, a pressure kneader or the like is used to melt or soften the base of styrene-acryl copolymer to make a uniform mixture (Step 2). After the mixture is cooled down to normal temperature, a hammer mill or a cutter mill is used to crush the product into particles of 1–3 mm and a jet mill or the like is used to further crush them into particles of about 8 μm (Step 3). Of the colored resin particles thus produced those which are too large or too small are removed by a pneumatic sorting device making use of centrifugal force to obtain particles of average diameter about 8 μm (Step 4). Colored resin particles of Types A-D having four different colors may be produced by using the same apparatus. Only ordinary washing is needed.

Charge controlling particles are produced similarly in Steps 5–8 of FIG. 2. The material with which this process is started is, as shown in Table 2, a mixture of styrene-acryl copolymer and propylene as the base and quaternary ammonium salt added as the charge controlling agent. The crushing and sorting processes (Steps 7 and 8) are carried out such that the average particle diameter of the charge controlling particles is about 1 μm. It is preferable that a different set of apparatus be used in the production of charge controlling particles from those for the production of colored resin particles.

Thereafter, each type of colored resin particles A–D and the charge controlling particles thus produced are mixed together. A mixer or the like may be used, for example, to mix equal amounts of colored resin particles of Type A and the charge controlling particles (Step 9). FIG. 3 shows schematically how charge controlling particles 12' of average diameter 1 μm are attached to an external surface of a colored resin particle 11' of diameter about 8 μm after mixing (Step 9). Thereafter, a crusher or the like is used to apply a mechanical pressure to these particles such that these particles will not be crushed but a charge controlling layer 12 will be formed around the colored resin members as shown in FIG. 1 (Step 10). Red, blue and green toner particles are similarly produced. Toner particles thus produced and a carrier comprising reduced iron powder, etc. were mixed at the ratio of 5:95 and the developer thus prepared was used in an electrophotographic process with a copier. Images of high quality could be thereby obtained.

For the purpose of comparison, toner particles of four different colors (Types A', B', C' and D') were produced by a conventional method. For this comparison experiment, quaternary ammonium salt as a charge controlling agent and a pigment were simultaneously mixed together with a base of styrene-acryl copolymer, polystyrene and polypropylene as shown in Table 3 and toner particles of average diameter about 10 μm were produced by steps similar to those described above by way of FIG. 2. After the toner A' was produced, the apparatus used for the production were washed in an ordinary manner and used again for the production of the toner B'. Thereafter, they were washed similarly to be used again for the production of Types C' and D'. The toners thus produced were mixed with a carrier comprising reduced iron powder at the ratio of 5:95 and the developers thus prepared were used with a copier. Good black images could be obtained with the toner of Type A' but the images formed with toners B', C' and D' were of poor quality with extensive fogging.

Figure 5:
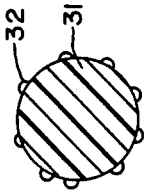
FIG. 5 is a sectional view of a toner particle produced by the process shown in FIG. 4.
Figure 4:
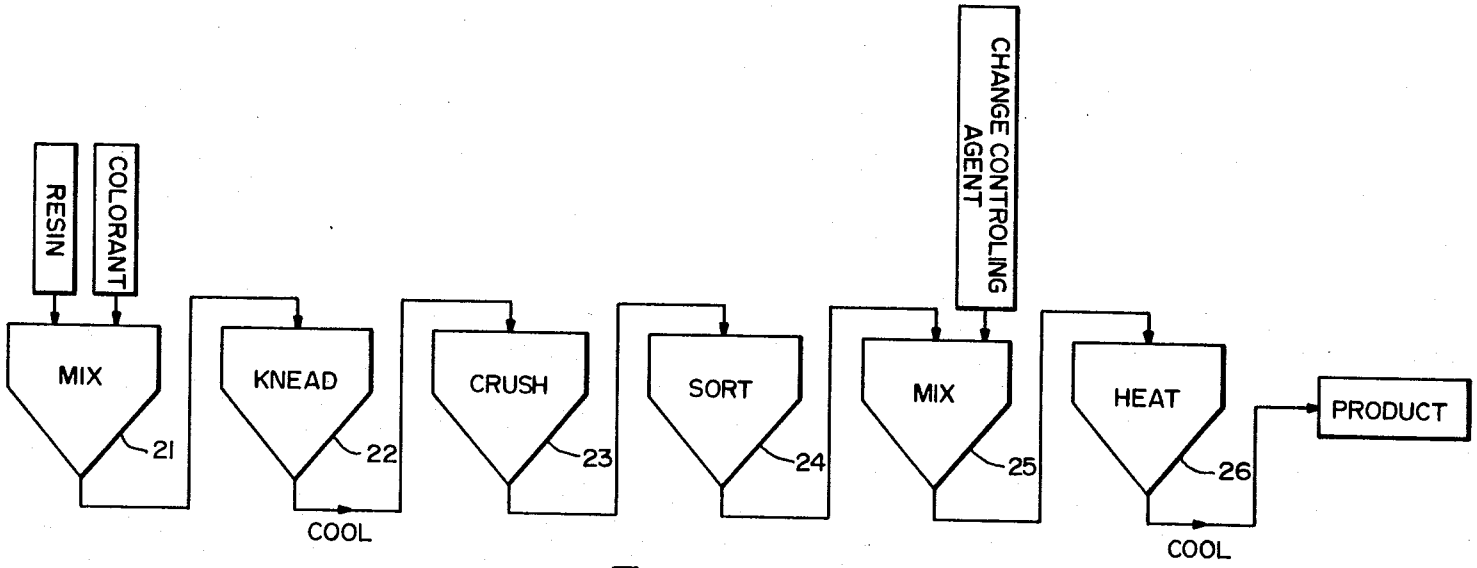
FIG. 4 is a drawing for schematically showing another production process of toner particles embodying the present invention.

FIG. 4 shows another method of the present invention for producing toner particles having charge controlling agent dispersed uniformly over their surfaces. In Step 21, a resin material in the form of chips and powder of a colorant are mixed thoroughly by using a mixer or the like and this mixture is melted or softened by means of heater rollers and kneaded to uniformly disperse the colorant inside the resin material (Step 22). This kneaded mixture of resin material and colorant is naturally cooled and thereafter crushed by a hammer mill to produce rough particles and by a jet mill to produce finer particles of about 10 μm (Step 23). As explained above with reference to FIG. 2, particles which are too large or too small are removed (Step 24) to obtain particles of average diameter about 10 μm. Particles thus obtained become toner cores. Next, powder of charge controlling agent is added to and mixed with these core particles (Step 25) and the mixture is heated at a low temperature (Step 26) to melt the charge controlling agent such that it becomes attached to the surfaces of the core particles. The final product is obtained by cooling them to normal temperature. A toner particle thus produced, as shown in FIG. 5 contains no charge controlling agent in the core 31. Charge controlling particles 32 are melted and attached only to its surface.

Figure 7:
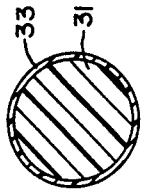
FIG. 7 is a sectional view of still another toner particle produced by still another process similar to the production process shown by FIG. 4.
Figure 6:
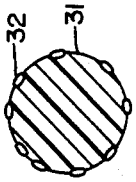
FIG. 6 is a sectional view of a toner particle produced by another process similar to the production process shown by FIG. 4.

Toner particles produced by alternative methods of the present invention are shown in FIGS. 6 and 7. The particle shown in FIG. 6 is characterized as having charge controlling particles 32 attached to the surface of the core 31 by compression. Such toner particles can be produced as explained above by way of FIG. 4 except a crusher or the like is used after Step 25 so as to apply thereto a pressure which is sufficiently weak and does not break up the core particles. The particle shown in FIG. 7, on the other hand, is characterized as having on the surface of its core 31 a coating layer 33 composed of a resin material and a charge controlling agent. Such toner particles can be produced, after the core particles are prepared as explained above by way of FIG. 4, by coating them with a coating material formed by dispersing a charge controlling agent inside a resin material.

Toners described above are economical to produce because charge controlling agent is not contained in the interior of the particles, that is, not in the cores and hence charge controlling agent is not wasted. Moreover, since the charge controlling agent or a coating agent containing it is attached to the surface of the core particles which are formed separately, the charge controlling agent is uniformly distributed and this prevents their electrostatic characteristics from becoming unstable. On the other hand, however, it may sometimes happen that the charge controlling agent is not distributed sufficiently uniformly over the surfaces of the core particles. This may cause the toner particles to be unevenly charged and if the toner particles cannot be stably attached to the surface of a photosensitive body used in electrophotography, the quality of the image thereby formed is adversely affected.

Figure 8:
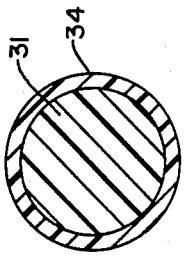
FIG. 8 is a sectional view of still another toner particle embodying the present invention.

The present invention, therefore, discloses still another method of producing toner particles which are characterised as havingoon the external surfaces of their core particles 31 an electrostatic layer 34 having a uniform electrostatic characteristic and hence can be charged uniformly by friction with the carrier. FIG. 8 shows a sectional view of a toner particle produced by this method.

Figure 9:
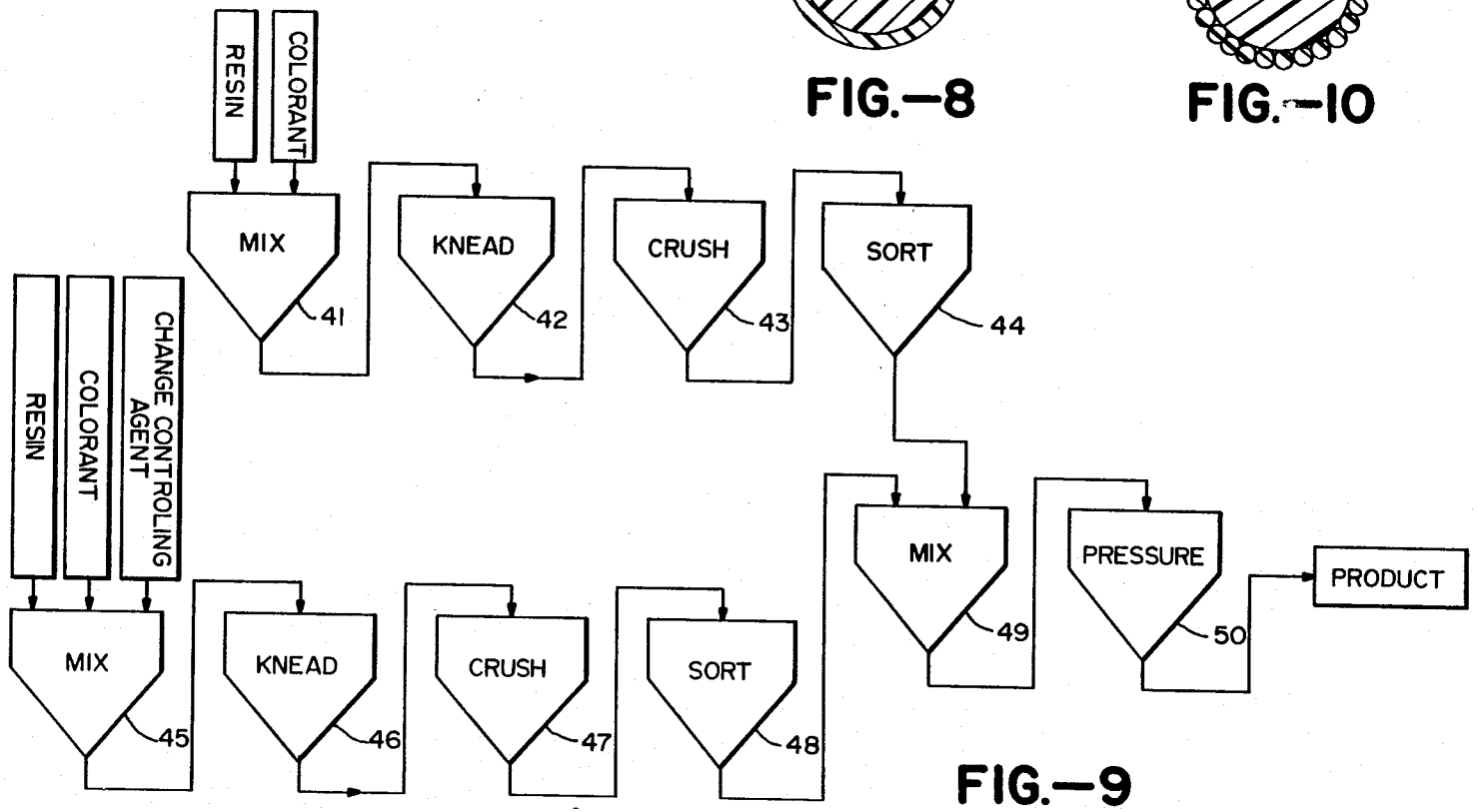
FIG. 9 is a drawing for schematically showing the production process of toner particles shown in FIG. 8.

Toner particles as shown in FIG. 8 can be produced as shown in FIG. 9. Core particles 31 of about 6 μm in diameter are produced by Steps 41, 42, 43 and 44 which substantially correspond to Steps 21, 22, 23 and 24 of FIG. 4. Independently of the aforementioned preparation of core particles 31, electrostatic particles are prepared by a similar series of steps (45, 46, 47 and 48). In Step 45, a resin material, a colorant and a charge controlling agent in powder form are uniformly mixed and they are kneaded together (Step 46) such that the charge controlling agent is uniformly dispersed throughout the resin material. Next, this kneaded substance is crushed into particles of 1–2 μm in size (Step 47) and these particles are sorted (Step 48) according to their sizes to produce the desired electrostatic particles.

Figure 10:
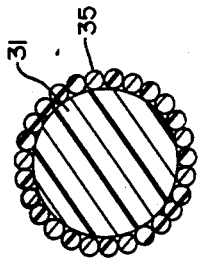
FIG. 10 is a sectional view of a toner particle during the production process shown in FIG. 9.

The core particles and the electrostatic particles thus produced separately are mixed together in Step 49. FIG. 10 shows how a toner particle may look at this stage with electrostatic particles 35 attached to the external surface of a core particle 31. A pressure is lightly applied to such particles next in Step 50 by using a mixer or a mill such that these electrostatic particles 35 are compressed and attached onto the surfaces of the core particles 31.

Toner particles thus produced are characterized, as explained above, as not containing any charge controlling agent in the core part which does not participate in electrostatic charging but as having such charge controlling agent only on the external surfaces. In other words, the charge controlling agent is not used wastefully. Moreover, since the charge controlling agent is uniformly dispersed throughout the electrostatic particles 35 which form the electrostatic layer 34 of FIG. 8, the toner particles described above are always uniformly charged and become stably attached to a photosensitive surface in an electrophotographic process. As a result, the quality of the image formed thereby can be significantly improved by using the toner of the present invention.

The foregoing description of preferred embodiments of the invention has been presented for purposes of illustration and description. It is not intended to be exhaustive or to limit the invention to the precise form disclosed, and many modifications and variations are possible in light of the above teaching. For example, where application of pressure was taught above to attach electrostatic particles onto core particles by compression, a heating process may be substituted such that the electrostatic particles are heated so as to become soft enough to become attached to the core particles. Any modifications and variations that may be apparent to a person skilled in the art are intended to be included within the scope of this invention.

What is claimed is:

1. A method of producing toner particles for use in electrophotography with particles having a colored resin core containing resin and a colorant and a charge controlling layer on the outer surface of said colored resin core, said charge controlling layer containing a charge controlling agent but not containing any colorant, said method comprising the steps of preparing toner core particles by mixing, kneading, crushing and sorting a first material including a resin material and a colorant, preparing charge controlling particles with smaller diameters than said toner core particles by mixing, kneading, crushing and sorting a second material including a charge controlling agent, and thereafter mixing said toner core particles with said charge controlling particles and causing a charge controlling layer to be formed around said toner core particles by applying a pressure to said mixed particles.

2. The method of claim 1 wherein said toner particles are about 10 $\mu$m in size.

3. The method of claim 1 wherein said colored resin member is about 8 $\mu$ m in diameter.

4. The method of claim 1 wherein said first material includes styrene-acryl copolymer, polystyrene and polypropylene.

5. The method of claim 1 wherein said second material includes styrene-acryl copolymer, polypropylene and quaternary amonium salt.

6. The method of claim 1 wherein said second material further includes a resin.

7. The method of claim 6 wherein said second material further includes a colorant.

8. The method of claim 1 wherein said pressure is weak enough not to crush said mixed toner core particles.

* * * * *